US007051557B2

(12) United States Patent
Mitchell et al.

(10) Patent No.: US 7,051,557 B2
(45) Date of Patent: May 30, 2006

(54) HIDDEN BAND BRASSIERE, BLANK AND METHODS OF MAKING SAME

(75) Inventors: John Mitchell, Asheboro, NC (US); Sandy Ann Waitz, Dingman's Ferry, PA (US)

(73) Assignee: Sara Lee Corporation, Winston-Salem, NC (US)

( * ) Notice: Subject to any disclaimer, the term of this patent is extended or adjusted under 35 U.S.C. 154(b) by 422 days.

(21) Appl. No.: 10/198,731

(22) Filed: Jul. 18, 2002

(65) Prior Publication Data

US 2004/0014394 A1 Jan. 22, 2004

(51) Int. Cl.
*A41B 9/16* (2006.01)

(52) U.S. Cl. ..... 66/179; 450/92

(58) Field of Classification Search ..... 66/176, 66/171, 177, 8, 172 R, 175, 196, 197; 450/156, 450/10, 30, 31, 37, 92
See application file for complete search history.

(56) References Cited

U.S. PATENT DOCUMENTS

| | | | | |
|---|---|---|---|---|
| 2,883,988 | A | 4/1959 | Lee | |
| 2,971,514 | A | 2/1961 | Steinmetz | |
| 3,489,154 | A | 1/1970 | Kaspar et al. | |
| 3,568,681 | A | 3/1971 | Comollo | |
| 3,595,034 | A * | 7/1971 | Safrit | 66/27 |
| 3,772,899 | A | 11/1973 | Novi | |
| 4,499,741 | A | 2/1985 | Harris | |
| 4,531,525 | A | 7/1985 | Richards | |
| 4,572,195 | A | 2/1986 | Hyams | |
| 4,663,946 | A | 5/1987 | Wright | |
| 4,911,677 | A | 3/1990 | White | |
| 4,976,653 | A | 12/1990 | White | |
| 5,081,854 | A | 1/1992 | Lonati | |
| 5,385,502 | A | 1/1995 | Moretz et al. | |
| 5,479,791 | A * | 1/1996 | Osborne | 66/171 |
| 5,547,971 | A | 8/1996 | Weithmann et al. | |
| 5,553,468 | A | 9/1996 | Osborne | |
| 5,590,548 | A | 1/1997 | Osborne | |
| 5,592,836 | A | 1/1997 | Schuster et al. | |
| 5,702,285 | A | 12/1997 | Orlando | |
| 5,850,745 | A * | 12/1998 | Albright | 66/176 |
| 5,882,242 | A | 3/1999 | Hardy | |
| 5,899,790 | A | 5/1999 | Berg | |
| 5,946,944 | A | 9/1999 | Osborne | |
| 6,023,785 | A | 2/2000 | Johnson | |
| 6,099,382 | A | 8/2000 | Wilson | |
| 6,102,772 | A | 8/2000 | Fernandez | |
| 6,125,664 | A | 10/2000 | Browder, Jr. | |
| 6,164,094 | A | 12/2000 | Lonati et al. | |
| 6,176,761 | B1 | 1/2001 | Underhill | |
| 6,178,784 | B1 | 1/2001 | Marley, Jr. | |
| 6,192,717 | B1 | 2/2001 | Rabinowicz | |
| 6,287,168 | B1 | 9/2001 | Raninowicz | |
| 6,332,825 | B1 | 12/2001 | Henricksen | |
| 2002/0002023 | A1 | 1/2002 | Nakanishi | |
| 2002/0022433 | A1 | 2/2002 | Yeung et al. | |

* cited by examiner

*Primary Examiner*—Danny Worrell
(74) *Attorney, Agent, or Firm*—Ohlandt, Greeley Ruggiero & Perle LLP

(57) ABSTRACT

A circular knit bra is provided. The bra has a torso encircling shape with a torso part having an outer fabric, an inner fabric, and a bra bottom. The outer fabric and the inner fabric each have a lower edge. The outer fabric and the inner fabric form a double layer. An integrally knitted reinforced anchoring chest band at the lower edge of the inner fabric forms a fold line, such that the anchoring chest band is concealed by the outer fabric layer. The bra bottom may have a smooth straight finished edge, a decorative scalloped edge, or a beaded edge mini-turned welt treatment.

40 Claims, 5 Drawing Sheets

HIDDEN BAND BRASSIERE, BLANK AND METHODS OF MAKING SAME

BACKGROUND OF THE INVENTION

1. Field of the Invention

The present invention relates to a brassiere, a blank for making the brassiere, and methods for making a brassiere and the blank on a circular knitting machine. More particularly, the present invention relates to a brassiere formed from a blank of a circular knitting machine in which the brassiere has an inner fabric layer, an outer fabric layer and an integrally knitted hidden anchoring chest band that connects the inner and the outer layers.

2. Description of the Prior Art

The use of generally cylindrical blanks in the manufacture of brassieres is known. For example, U.S. Pat. No. 4,531,525 describes the use of a circular knitting machine to produce a cylindrical blank having a pair of welt bands at opposite ends of the blank. A front torso portion is knit to one of the welts. A pair of breast cups is formed with knitting courses that use different stitches in the front torso portion. A strap and rear torso portion is knit to the front torso portion and to the other welt. To assemble the brassiere, the cylindrical blank is slit longitudinally and laid flat. The flat blank is then cut along a neck line and armhole lines to define straps and the rear torso portion. The blank is then folded and the two welts and the front and rear portions are sewn together. This method forms a single layer brassiere having an exposed welt anchoring portion.

U.S. Pat. Nos. 5,553,468 and 5,592,836 describe cylindrical blanks for the manufacture of brassieres. Each blank has a single welt at one end of the blank to which is knitted the front and rear torso portions. To assemble the brassiere, neck and armhole areas are cut from the blank to define front and rear strap portions in the front and rear torso portions. The front and rear straps are sewn together to complete the formation of the brassiere. The brassiere has a single fabric layer and an exposed anchoring chest band.

U.S. Pat. No. 6,287,168 B1 to Rabinowicz describes a brassiere formed from a circularly knit fabric blank having two layers. Each layer has a pair of breast cups that are arranged in mirror image about a band region at which the blank is folded to place one set of breast cups in overlaying relationship with the other set of breast cups. Thus, the brassiere has a two-ply structure. The band region is formed by removing a series of courses during knitting to produce a thinner fabric area at the fold. The finished brassiere has two fabric layers and an exposed anchoring chest band.

Therefore, a need exists for a two-ply brassiere formed from a circularly knit blank that has an outer fabric layer, an inner fabric layer and an integrally knitted reinforced anchoring chest band. Added yarns increase the density and modulus of the reinforced anchoring chest band. The differing density between the outer fabric layer and the reinforced anchoring chest band forms a line of demarcation about which the brassiere is folded. The anchoring chest band is concealed or hidden by the outer fabric layer in the folded brassiere.

SUMMARY OF THE INVENTION

It is an object of the present invention to provide a seamless circular knit brassiere or bra formed from a brassiere blank having an inner layer of fabric, an outer layer of fabric, and preferably having an integrally knitted anchoring chest band seamlessly knitted to the inner and outer layers of fabric.

It is another object of the present invention to provide such a brassiere having a line of demarcation formed at the area where the outer fabric layer and the anchoring chest band meet. Added spandex yarns create a reinforced inner anchoring chest band having greater modulus and density than the outer layer fabric, which lacks such added spandex yarns. The greater modulus and density of the inner anchoring chest band makes the anchoring chest band area resistant to folding or bending. The contrasting fabric densities of the inner reinforced anchoring chest band and the outer fabric layer create a natural fold line along the anchoring chest band edge, thereby forcing the less dense and lower modulus outer layer to fold along the inner reinforced anchoring chest band.

It is yet another object of the present invention to provide such a brassiere in which the bra blank is folded about the line of demarcation to form a finished brassiere in which the anchoring chest band is hidden by the outer layer.

It is still another object of the present invention to provide such a brassiere in which elastomeric yarns having a greater denier and greater density than those used to form the inner and outer fabric layers are added during the knitting process to produce a reinforced anchoring chest band having increased modulus and for providing support to the wearer.

It is a further object of the present invention to provide such a brassiere in which the area at which the outer fabric layer meets the anchoring chest band defines a fold line that forms a brassiere having a straight, flat edge.

It a still further object of the present invention to provide a seamless circular knit brassiere having an inner layer of fabric, an outer layer of fabric, and an integrally knitted reinforced anchoring chest band seamlessly knitted between said inner layer of fabric and said outer layer of fabric, in which the brassiere bottom has a knitted in decorative edge such as a scalloped or picot edge formed during the knitting process.

It is still another object of the present invention to provide a seamless circular knit brassiere having an inner layer of fabric, an outer layer of fabric, and an integral mini-turned welt seamlessly knitted to the inner and outer layers of fabric in which the area at which the outer fabric layer meets the mini-turned welt forms a line of demarcation about which the blank is folded to form a finished brassiere. A mini-turned welt is a short turned welt length comprised of a specified minimal number of courses. For example, a mini-turned welt may be formed entirely on cylinder needles using methods well known in the art, such as by transferring held loops from cylinder needles to cylinder needles for a duration of knitting a defined short welt length comprised of a specific minimal number of courses, or, by using held loops on dial bits to complete the welt formation.

It is still a further object of the present invention to provide such a brassiere having mini-turned welt that serves as a fold line, thereby forming a straight line beaded bottom edge of the brassiere that may be integrally knitted to the hidden anchoring chest band.

These and other objects and advantages of the present invention will be achieved by a brassiere having a torso encircling shape, with an outer fabric and an inner fabric. The outer fabric and the inner fabric meet at a lower edge that is seamlessly joined during knitting. The outer fabric and the inner fabric form a double layer brassiere in which the lower edge of the outer fabric is integrally knitted to the inner reinforced anchoring chest band, forming a fold line, and wherein the body encircling anchoring chest band is concealed by the outer fabric.

A method of making a brassiere according to the present invention comprises the steps of first forming a generally cylindrical blank. The blank having first and second upper torso parts. Each upper torso part has a bottom edge. The upper torso parts and the lower torso parts are seamlessly joined at the bottom edge. The spandex reinforced anchoring chest band, located on the inner fabric layer, forms a fold line in the area where the higher modulus reinforced anchoring chest band meets the lower modulus outer fabric portion. A pair of front and rear straps are formed in each of the upper torso parts to define a neckline and armholes or straps may be added in convention separate operations. Areas of each of the upper torso parts adjacent to the straps are cut and removed to define the neckline and armholes. The first and second upper torso parts are tacked together and finished in a manner such that the first and second torso parts become inner and outer torso parts of the brassiere. The distal ends of the straps are joined together to form right and left straps, or strap platforms.

BRIEF DESCRIPTION OF THE DRAWINGS

The foregoing and still other objects and advantages of the present invention will be more apparent from the following detailed explanation of the preferred embodiments of the present invention in connection with the accompanying drawings.

DETAILED DESCRIPTION OF THE INVENTION

Figure 1:
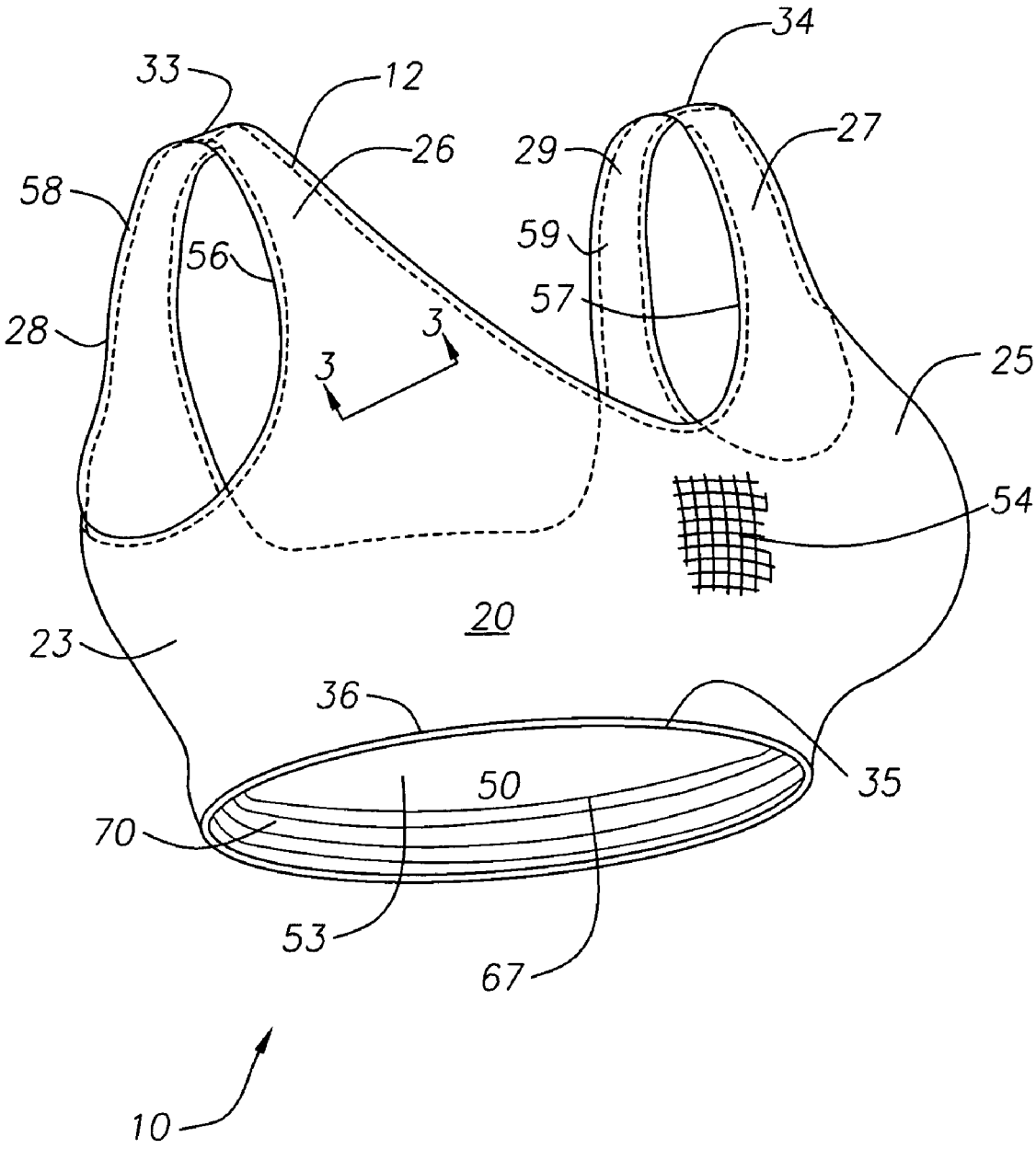
FIG. 1 is a perspective view of a brassiere according to one embodiment of the present invention.
Figure 2:
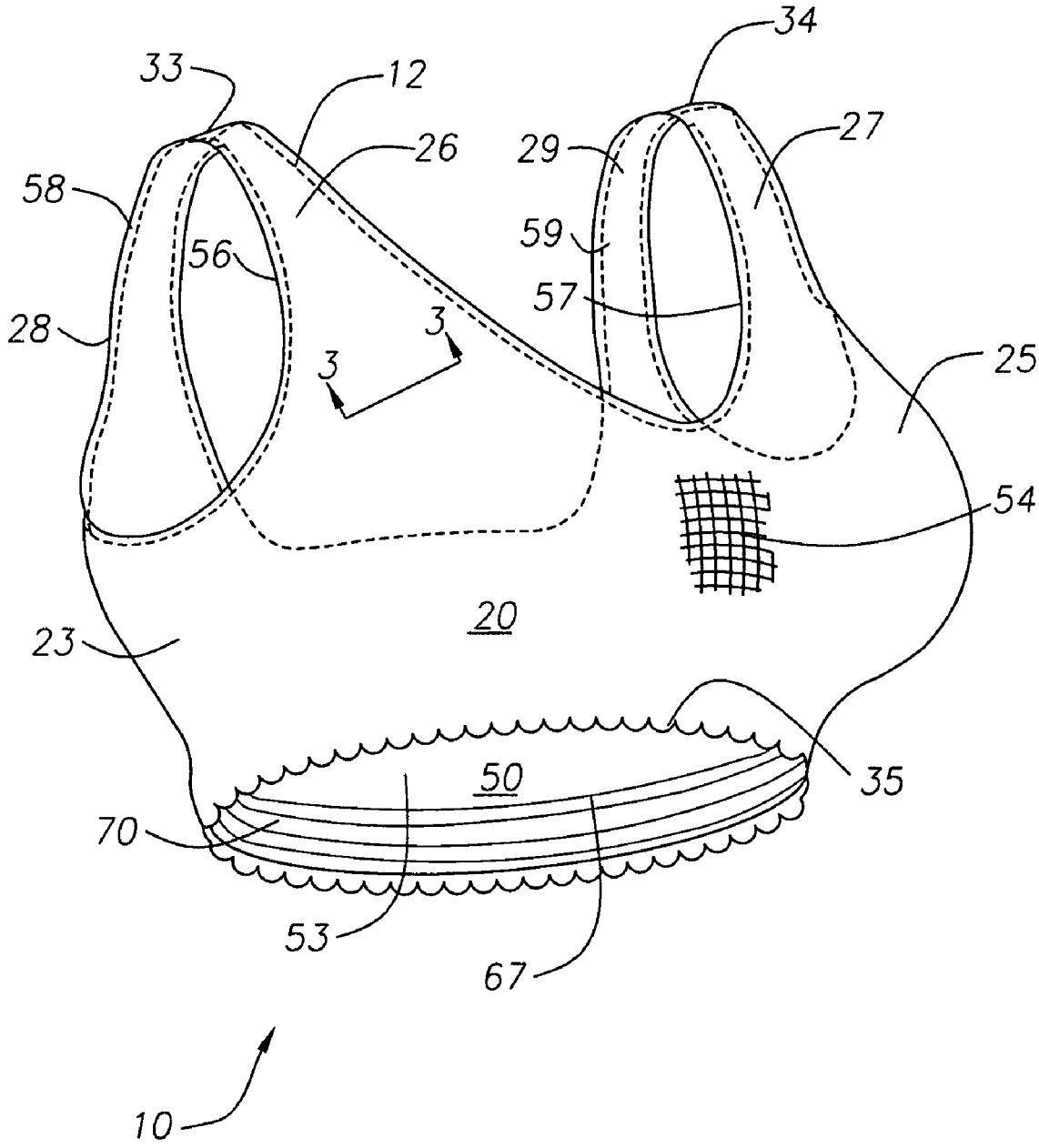
FIG. 2 is a perspective view of a brassiere according to an alternate embodiment of the present invention.

Referring to the drawings and, in particular, FIGS. 1 and 2, there is illustrated a bra or brassiere according to the present invention generally represented by reference numeral 10. Brassiere 10 has an outer fabric or outer fabric layer 20, an inner fabric or inner fabric layer 50, an anchoring chest band 70 that is integrally knitted into inner layer 50 and joins the outer fabric layer and the inner fabric layer. Anchoring chest band 70 is preferably a heavier denier spandex reinforced fabric construction having torso encircling shape that anchors brassiere 10 to the wearer's body and is concealed or hidden by outer fabric layer 20.

Outer fabric layer 20 has an upper torso part 23 and a bra bottom 35. Upper torso part 23 is integrally joined to anchoring chest band 70 in a seamless manner at bra bottom 35. In the preferred embodiment, upper torso part 23 preferably has formed therein a pair of breast cups 25, a first or right front strap or strap portion 26, a second or left front strap or strap portion 27, a first or right rear strap or strap portion 28, and a second or left rear strap or strap portion 29. However, it is to be understood that the present invention may be practiced on a traditional, strapless, racer back, or halter-type brassiere.

Inner fabric layer 50 has an upper torso part 53. Upper torso part 53 has a lower edge 35 that is integrally joined to anchoring chest band 70 in a seamless manner. In the preferred embodiment, upper torso part 53 has a first or right front strap 56, a second or left front strap 57, a first or right rear strap 58, a second or left rear strap 59, and a center gathered panel area 54 located between breast cups or areas 25.

In the preferred embodiment shown in FIG. 1 anchoring chest band 70 joins outer fabric layer 20 and inner fabric layer 50. Anchoring chest band 70 is formed by adding in, during the circular knitting process, additional heavier denier bare spandex elastomeric yarn or, less preferably, a nylon covered spandex yarn thereby causing a greater fabric density in the inner layer anchoring chest band portion than the fabric and yarn density used to form adjacent outer fabric layer 20 and inner fabric layer 50. Added in yarns of increased density provide increased modulus, power and stretch properties to anchoring chest band 70, thereby facilitating a functional fit and comfort level to the garment wearer while anchoring brassiere 10 properly on the wearer's body. The higher denier spandex provides additional power to stretch and recovery performance properties to anchoring chest band 70 and makes certain that brassiere 10 stays in place on the wearer's body.

Preferably, anchoring chest band 70 is formed from an additional elastomeric yarn, preferably spandex, having a range of from 120 to 420 denier. More preferably, the elastomeric spandex yarn is manufactured by duPont and sold under the name Lycra®. In a most preferred embodiment, the elastomeric yarn is added in on every fourth course, thereby producing an elevated modulus and power control in anchoring chest band 70.

Figure 5:
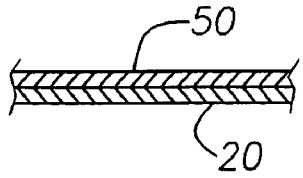
FIG. 5 is an enlarged cross-sectional view taken along line 3—3 of FIGS. 1, 2 and 3.

The differential density between anchoring chest band 70, having added in heavier denier spandex yarns, and the less dense adjacent areas namely, inner fabric layer 50 and outer fabric layer 20, forms a line of demarcation that enables the blank to be folded upon itself, either as a manual folding operation or, alternatively, when knitting the blank essentially as a long turned welt. Thus, when folded, inner fabric layer 50 faces the wearer's body and outer fabric layer 20 faces away from the wearer's body. FIG. 5 is an enlarged cross-sectional view taken along line 3—3 of FIGS. 1, 2 and 3 illustrating such a two-ply construction of brassiere 10.

Figure 8:
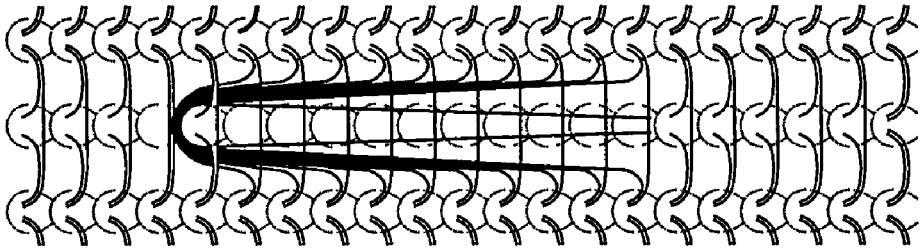
FIG. 8 is an enlarged view of the combined non-elastomeric yarn knitted as in FIG. 6 with the elastomeric yarn as in FIG. 7, the resulting combination forming the gathering tack-point stitch method for forming a scalloped edge to the bra bottom.
Figure 7:
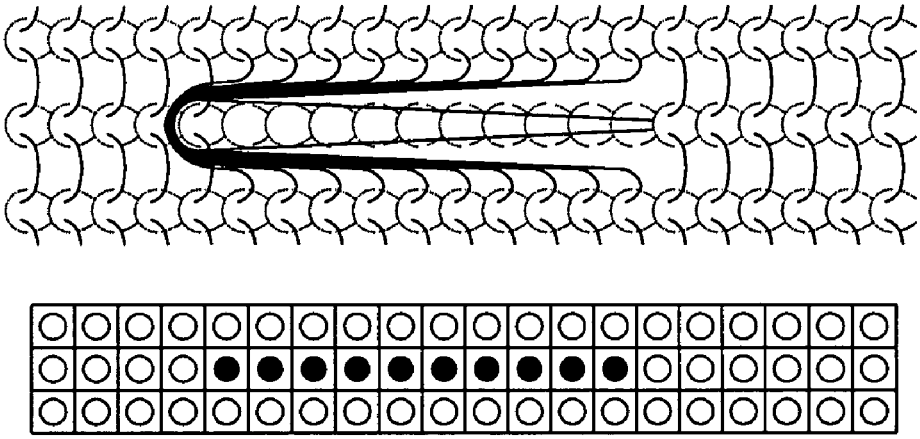
FIG. 7 is an enlarged view of a knit and tuck pattern technique used for creating a spaced scallop decorative edge treatment integrally knitted to an inner fabric layer anchoring chest band using an elastomeric yarn.
Figure 6:
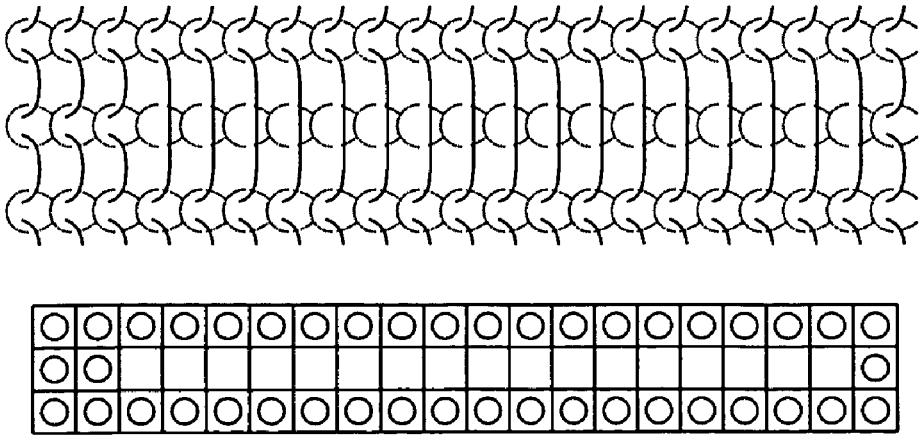
FIG. 6 is an enlarged view of a knit and miss stitch pattern for the knitting stitch technique used to create a spaced scallop decorative edge treatment integrally knitted to a hidden anchoring chest band of the present invention using a non-elastomeric yarn.

FIG. 6 illustrates a rigid yarn flat or textured nylon feed knit and miss pattern technique used to form a decorative scallop edge treatment embodiment of FIG. 2. FIG. 7 illustrates a covered spandex yarn knit and tuck pattern that is also used to form the scallop decorative edge. The combined yarn and stitch techniques of both FIG. 6 and FIG. 7 together are illustrated in FIG. 8, and are used to form the scallop decorative edge treatment brassiere embodiment shown in FIG. 2.

In an alternate embodiment of the present invention shown in FIG. 2, a finished decorative scalloped or picot edge is formed at bra bottom 35. The scalloped edge is formed using a gathering tack point method. This embodiment is preferably knitted on a 28 needle per inch gauge circular knitting machine. Knit and miss and knit and tuck pattern combinations are repeated widthwise on one needle at regular intervals. For example, knit and tuck pattern combinations may be repeated every 24th needle around the circumference of the circular knit machine cylinder. The lengthwise or vertical repeat of the gathered tack point is preferably from 32 to 40 courses in length and, thus, spaced held loop stitching points are formed along bra bottom 35 during the knitting process. FIG. 8 illustrates the tack point method of stitching used to form the scalloped edge. Additionally, the hidden, integrally knitted anchoring chest band 70 is incorporated into the inner fabric layer 50 beginning at a point where the knit formation of the scallop edge is completed, thereby defining a fold line at the scalloped edge treatment of brassiere 10.

Figure 3:
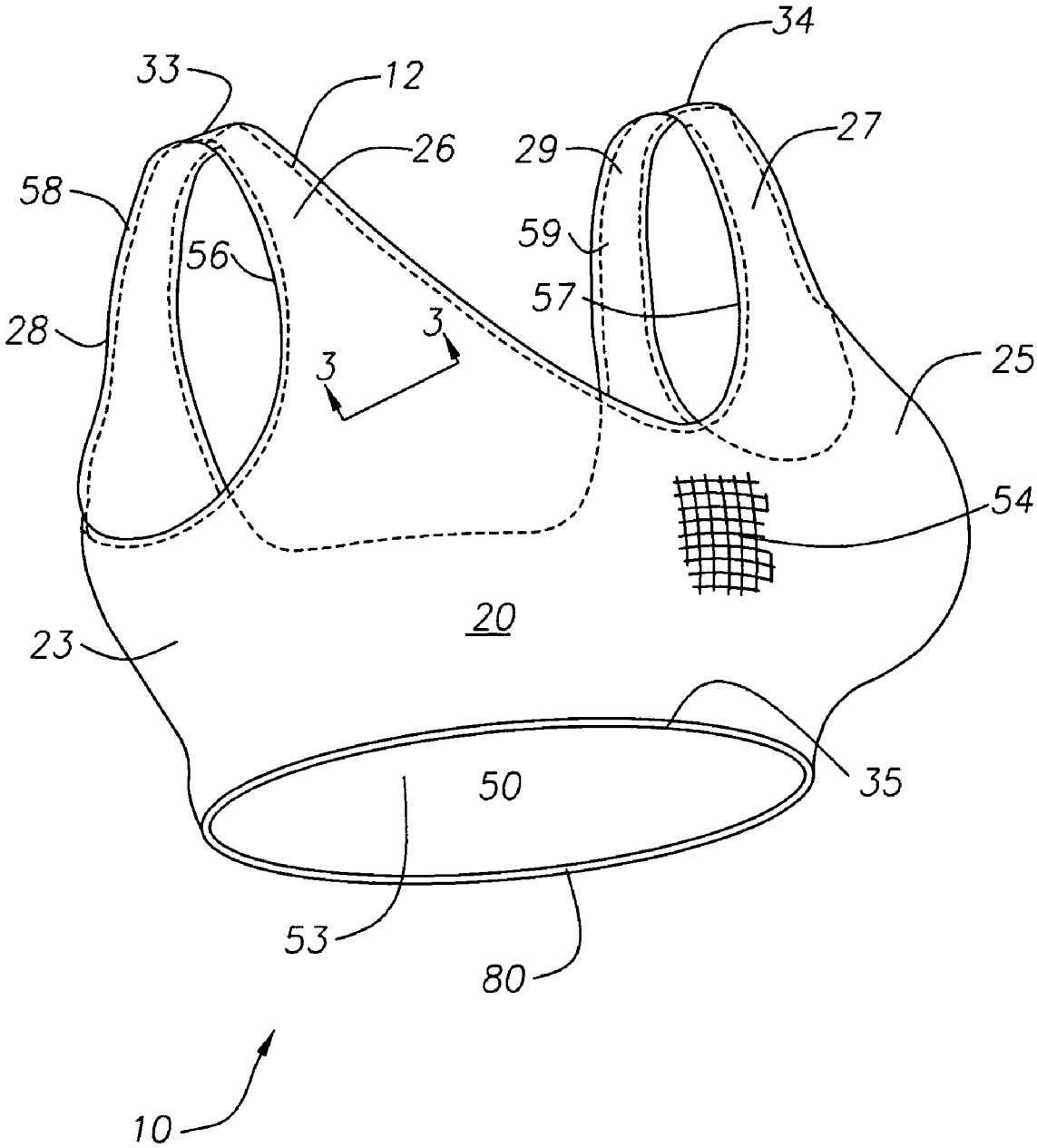
FIG. 3 is a perspective view of a brassiere according to a third embodiment of the present invention.

In a less preferred embodiment of the present invention illustrated in FIG. 3, brassiere 10 has a small or mini-turned welt 80, that joins outer fabric layer 20 and inner fabric layer 50 at the bra bottom 35. In this embodiment, mini-turned welt 80 is knitted using relatively few courses to provide brassiere 10 with a relatively smooth outer fabric layer 20 and finished bra bottom 35 with a beaded edge. Mini-turned welt 80 is formed entirely on cylinder needles by transferring held loops from cylinder needles to cylinder needles for a duration of knitting a defined short welt length comprised of a specific minimal number of courses. Mini-turned welt 80 is preferably formed using a repeat length of from 8 to 24 courses, thereby forming an area ⅛ inch to ¼ inch in width. Mini-turned welt 80 functions to effect a fold of outer layer 20 over inner fabric 50. In the preferred embodiment, the reinforced anchoring chest band is integrally knitted into the inner fabric layer. In a less preferred embodiment, the edge treatment can be used without integrally knitting the reinforced anchoring chest band into the inner layer.

A seam 33 joins right front straps 26 and 56, and right rear straps 28 and 58, together. A seam 34 joins left front straps 27 and 57 and left rear straps 29 and 59 together. Outer fabric layer 20 and inner fabric layer 50 are joined together at outer seam 12. Outer seam 12 may be formed using attachment means known in the art. Examples of such methods for attachment include sewing, heat lamination, using a thermoplastic adhesive or other adhesive type materials, ultra sonic or sonic welding, or any combinations of sewing, heat lamination and welding.

Outer fabric layer 20 is formed on a circular knitting machine using one or any combination of knit stitches. Such stitches may include, but are not limited to plain, tuck, knit, miss or float stitches. Outer fabric layer 20 may have a plain appearance or, optionally, may have unique aesthetic and recognizable knitted-in characteristics including, but not limited to, a Jacquard pattern design, geometric, stylized logo, abstract, or other designs or patterns such as florals.

Outer fabric layer 20 is preferably made of synthetic continuous multifilament flat or textured polymer or spun yarn. The outer fabric preferably also has an elastomeric yarn, such as bare spandex or spandex that is covered with a textured multifilament nylon yarn. The combination of yarns forms a fabric that may contain a spun yarn such as cotton in the range about 40/1's to about 60/1's count or synthetic continuous multifilament flat or textured yarn such as nylon from about 10 to about 200 denier, and preferably about 80 to about 120 denier.

Inner fabric layer 50 is formed with yarns selected for softness, comfort and wicking properties. Inner fabric layer 50 has yarns with one or any combination of stitches to provide bodily comfort and support to the wearer. Inner fabric layer 50 is made of either textured nylon comprised of a relatively high number of fine denier filaments or a microfiber having about 20 to about 120 denier or spun yarn, such as cotton, in the size range of about 40/1's to about 60/1's cotton count. Such yarn provides softness, comfort and desired wicking properties. The inner layer may also contain an elastomeric stretch yarn such as spandex. The knit construction of inner fabric layer 50 may be any combination of conventional knit stitches with the potential additional yarns or knit constructions, such as a true sinker produced terry loop added in strategically engineered areas to provide support or lift. Such strategic areas are, for example, under the breast cups 25 or in the center gathered panel area 54 between breast cups 25.

Figure 4:
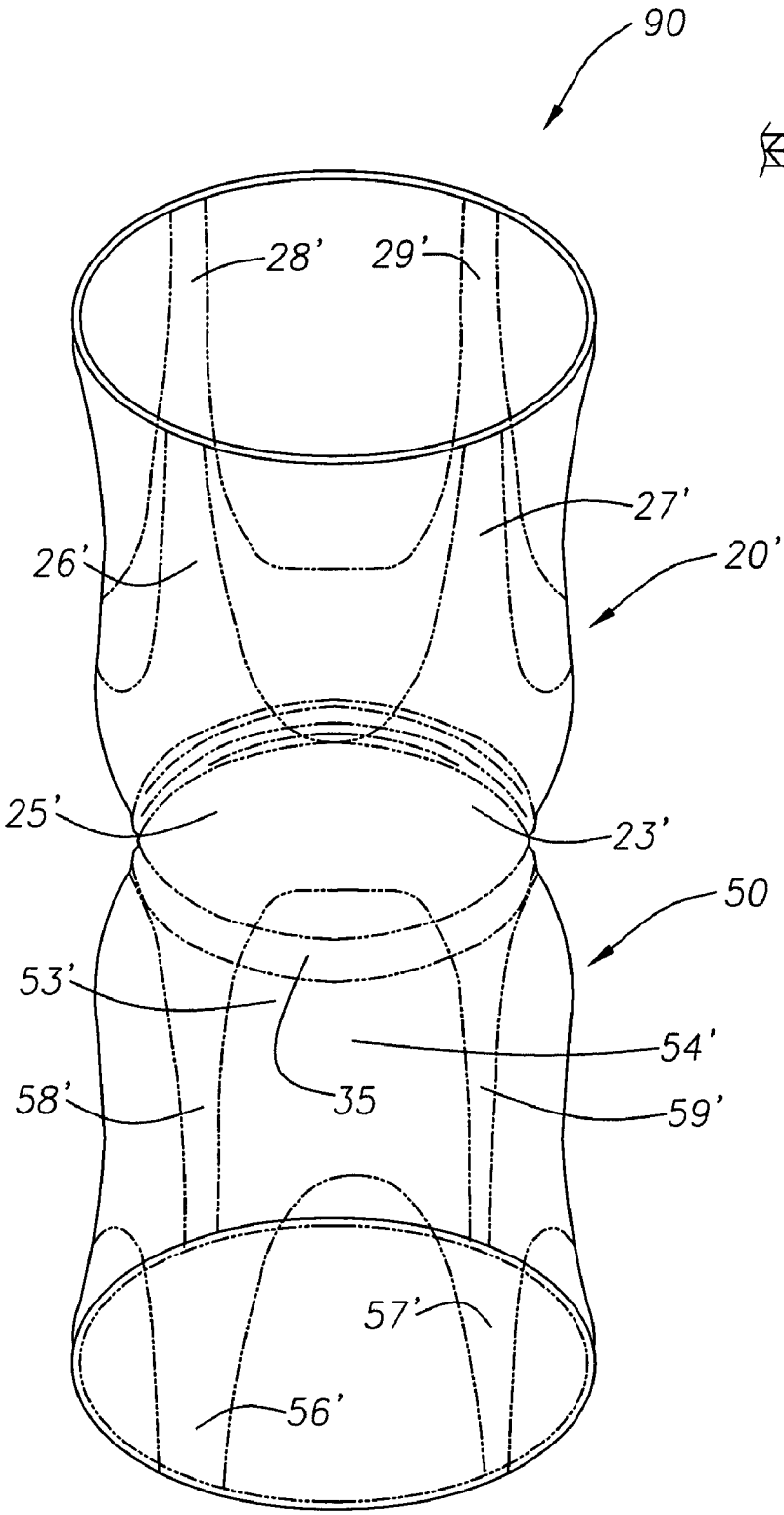
FIG. 4 is a perspective view of a generally cylindrical blank according to the present invention for use in the manufacture of the brassiere of FIGS. 1, 2 and 3.

Referring to FIG. 4, brassiere 10 is produced from a blank 90 that is formed on a circular knitting machine, preferably having a computerized electronic needle and yarn feed selection system such as circular knit machine Model No. SM8-8, or SM8-83 as manufactured by Santoni® of Brescia, Italy.

Blank 90 is a generally cylindrical tube having portions that, upon manufacture of brassiere 10, correspond to portions of the brassiere. For that reason, reference characters corresponding to those used above with reference to FIGS. 1, 2 and 3, will be applied in FIG. 4 with a prime notation.

Blank 90 has an outer fabric 20' and an inner fabric 50'. Outer fabric 20' has an upper torso part 23', a pair of outer front straps 26', 27', and a pair of outer rear straps 28', 29'. Inner fabric 50' has an upper torso part 53', a pair of front straps 56' and 57' and a pair of rear straps 58' and 59'.

Blank 90 is formed by a series of circular weft knitted courses. In the illustration depicted as FIG. 4, the complete blank is essentially knitted as a continuous tubular fabric of single ply configuration, which can then be folded at the fold line point, forming a two-ply final structure. Alternatively, the two-ply fabric structure may be knitted on the circular knitting machine as continuous long turned welt in a manner known in the art.

Upper torso parts 23' and 53' are formed mostly with simple knit constructions, such as knit, tuck, miss, or combinations thereof. Welt knit stitches may suitably be used to provide special features at various locations of blank 90, such as support for breast areas 25' and center gathered area 54'.

To manufacture brassiere 10, blank 90 is cut to form upper torso parts 23' and 53' by removing areas adjacent strap portions 26', 28', 27', 29', 56', 58', 57', and 59' thereby defining the neck line and arm holes of brassiere 10. Outer fabric layer 20' is then folded over inner fabric layer 50' at a fold line formed where inner fabric layer 50 meets anchoring chest band 70. The distal ends of strap portions 26', 28', 56' and 58' are sewn together at seam 33 to form the right strap of brassiere 10. The distal ends of strap portions 27', 29', 57', and 59' are sewn together at seam 34 to form the left strap of brassiere 10. Outer fabric layer 20' and inner fabric layer 50' are tacked together at tacking 12. Tacking 12 may be accomplished using attachment means known in the art. Examples of such methods for attachment include sewing, heat lamination, using a thermoplastic adhesive or other adhesive type materials, ultra sonic or sonic welding, or any combinations of sewing, heat lamination and welding.

The present invention has been described with particular reference to the preferred embodiments. It should be understood that the foregoing descriptions and examples are only illustrative of the present invention. Various alternatives and modifications thereof can be devised by those skilled in the art without departing from the spirit and scope of the present invention. Accordingly, the present invention is intended to embrace all such alternatives, modifications, and variations that fall within the scope of the appended claims.

What is claimed is:

1. A brassiere formed from an integral circular knit blank comprising:

a body having a torso encircling shape with a torso part, said torso part having an outer fabric layer and an inner fabric layer, each of said outer fabric layer and said inner fabric layer having a lower edge that is seamlessly joined to an integrally knitted anchoring chest band, wherein said band is concealed by said outer fabric layer.

2. The brassiere according to claim 1, wherein said brassiere has a pair of breast cups.

3. The brassiere according to claim 2, wherein said brassiere has a center gore panel disposed between said pair of breast cups.

4. The brassiere according to claim 2, wherein said inner fabric layer has knitted in support areas between said pair of breast cups.

5. The brassiere according to claim 2, wherein said inner fabric layer has knitted in support areas under said pair of breast cups.

6. The brassiere according to claim 1, wherein said integrally knitted anchoring chest band is reinforced by adding yarn to said anchoring chest band.

7. The brassiere according to claim 6, wherein said yarn is selected from the group consisting of multifilament flat, textured nylon, spun, and elastomeric yarns.

8. The brassiere according to claim 6, wherein said yarn is selected from the group consisting of synthetic continuous multifilament flat, textured nylon, spun, and elastomeric yarns.

9. The brassiere according to claim 6, wherein said yarn is an elastomeric yarn.

10. The brassiere according to claim 6, wherein said yarn is of greater denier than yarn used to form said outer fabric layer and said inner fabric layer.

11. The brassiere according to claim 6, wherein said yarn is spandex.

12. The brassiere according to claim 6, wherein said yarn has a denier in the range of 120 to 420.

13. The brassiere according to claim 1, wherein said integrally knitted reinforced anchoring chest band is formed using one or more stitches selected from the group consisting of knit, miss, and tuck.

14. The brassiere according to claim 1, wherein said outer fabric layer is formed of one or more yarns selected from the group consisting of cotton, nylon, elastomeric spandex, and any combinations thereof.

15. The brassiere according to claim 1, wherein said outer fabric layer is nylon and spandex.

16. The brassiere according to claim 1, wherein said outer fabric layer has one or more yarns, said one or more yarns have has a denier in the range of 10 to 200.

17. The brassiere according to claim 1, wherein said outer fabric layer is formed from one or more knit stitches selected from the group consisting of plain knit, miss, and tuck.

18. The brassiere according to claim 1, wherein said inner fabric layer is formed of one or more yarns selected from the group consisting of cotton, nylon, elastomeric spandex, and any combinations thereof.

19. The brassiere according to claim 18, wherein said inner fabric layer has one or more yarns, said one or more yarns having a denier in the range of 10 to 200.

20. The brassiere according to claim 1, wherein said inner fabric layer has one or more yarns that is a continuous multifilament fine denier nylon microfiber.

21. The brassiere according to claim 1, wherein said inner fabric layer is formed from one or more knit stitches selected from the group consisting of plain knit, miss, and tuck.

22. A brassiere formed from an integral circular blank comprising:

a body having a torso encircling shape with a torso part, said torso part having an outer fabric layer and an inner fabric layer, each of said outer fabric layer and said inner fabric layer having a lower common edge that is seamlessly joined to an integrally knitted reinforced anchoring chest band, wherein said chest band is concealed by said outer fabric layer, and wherein the brassiere has a decorative edge at said brassiere bottom.

23. The brassiere according to claim 22, wherein said brassiere has a pair of breast cups.

24. The brassiere according to claim 22, wherein said brassiere has a center gore panel disposed between said pair of breast cups.

25. The brassiere of claim 22, wherein said decorative edge is a scalloped edge.

26. The brassiere of claim 25 wherein said scalloped edge is formed by combining a knit and miss stitch pattern and a knit and tuck stitch pattern.

27. A brassiere formed from an integral circular blank comprising:

a body having a torso encircling shape with a torso part having an outer fabric layer and an inner fabric layer, each of said outer fabric layer and said inner fabric layer having a lower edge that is seamlessly joined to a mini-turned welt, said outer fabric and said inner fabric forming a double layer, wherein said mini-welt is concealed by said outer fabric layer, and wherein said mini-turned welt forms the bottom of said brassiere.

28. The brassiere according to claim 27, wherein said brassiere has a pair of breast cups.

29. The brassiere according to claim 27, wherein said brassiere has a center gore panel disposed between said pair of breast cups.

30. The brassiere of claim 27, wherein said mini-turned welt is a defined short welt length comprised of a minimal number of courses.

31. The brassiere of claim 27, wherein said mini-turned welt is formed using held loops on dial bits to complete the welt formation.

32. The brassiere of claim 27, wherein said welt is between 8 and 24 courses.

33. A single blank for manufacturing a brassiere, said blank comprising:

an outer fabric layer;

an inner fabric layer integrally knitted to said outer fabric layer, each of said outer fabric layer and said inner fabric layer having an upper torso part that has a bottom edge; and an anchoring chest band being positioned between said outer fabric layer and said inner fabric layer;

wherein a fold line is formed where said outer fabric layer and said anchoring chest band meet.

34. The blank according to claim 33, wherein said inner fabric layer is formed with a yarn having softness, comfort and wicking properties, and having one or more knit stitches to provide comfort to a wearer.

35. The brassiere according to claim 33, wherein said outer fabric layer includes a nylon yarn and one or more yarns that are selected from the group consisting of cotton, nylon, elastomeric spandex, and any combinations thereof.

36. The blank according to claim 33, wherein said fold line has a knitted in scalloped edge.

37. The blank according to claim 36, wherein said scalloped edge is formed by a stitch combination using knit and miss stitching of non-elastic yarn and knit and tuck stitch of elastomeric yarn.

38. The blank according to claim 33, wherein said fold line is a small mini-turned welt of between 8 and 24 courses.

39. The blank according to claim 38, wherein said mini-welt is formed entirely on cylinder needles by transferring held loops from cylinder needles to cylinder needles for a duration of knitting.

40. A method of making a brassiere comprising:

forming a generally cylindrical circular knitted single fabric layer blank by:

forming a first generally cylindrical upper torso part having a bottom edge seamlessly joined to an integrally knitted reinforced single fabric layer anchoring chest band, wherein said bottom edge of the band forms a fold line;

forming a second generally cylindrical upper torso part having a bottom edge seamlessly joined to said integrally knitted reinforced single fabric layer anchoring chest band;

forming in each of said upper torso parts a pair of front strap portions and a pair of rear strap portions to define a neckline and armholes;

cutting and removing areas of each of said upper torso parts that are adjacent to said strap portions to define said neck line and said arm holes;

tacking the first and second torso parts together in a manner that the first and second torso parts become outer and inner torso parts of the brassiere;

joining the distal ends of said right front strap portion; and said right rear strap portions together to form a right strap; and joining the distal ends of said left front strap portions and said left rear strap portions together to form a left strap.

* * * * *